US007396557B2

(12) United States Patent
Bauer et al.

(10) Patent No.: US 7,396,557 B2
(45) Date of Patent: Jul. 8, 2008

(54) METHOD FOR FORGERY-PROOF LABELING OF ITEMS, AND FORGERY-PROOF LABEL

(75) Inventors: Georg Bauer, Nürnberg (DE); Jörg Hassmann, Erlangen (DE); Harald Walter, Erlangen (DE); Wolf Bertling, Erlangen (DE)

(73) Assignee: november Aktiengesellschaft Gesellschaft fur Molekulare Medizin, Erlangen (DE)

( * ) Notice: Subject to any disclaimer, the term of this patent is extended or adjusted under 35 U.S.C. 154(b) by 623 days.

(21) Appl. No.: 10/363,111

(22) PCT Filed: Aug. 16, 2001

(86) PCT No.: PCT/DE01/03205

§ 371 (c)(1),
(2), (4) Date: Jun. 4, 2003

(87) PCT Pub. No.: WO02/18155

PCT Pub. Date: Mar. 7, 2002

(65) Prior Publication Data

US 2004/0026917 A1 Feb. 12, 2004

(51) Int. Cl.
*B41M 3/14* (2006.01)

(52) U.S. Cl. ..... 427/7; 427/162; 359/2

(58) Field of Classification Search ..... 427/7, 427/162; 359/2

See application file for complete search history.

(56) References Cited

U.S. PATENT DOCUMENTS

| | | | | |
|---|---|---|---|---|
| 4,252,891 | A * | 2/1981 | Kostyshin et al. | 430/323 |
| 5,611,998 | A | 3/1997 | Aussenegg et al. | |
| 5,786,910 | A * | 7/1998 | Walters et al. | 359/2 |
| 6,165,609 | A * | 12/2000 | Curatolo | 428/343 |

FOREIGN PATENT DOCUMENTS

| | | | |
|---|---|---|---|
| AT | 407165 | B | 1/2001 |
| DE | 43 42 964 | A1 | 6/1995 |
| DE | 198 36 813 | A1 | 2/2000 |
| DE | 199 27 051 | A1 | 12/2000 |
| EP | 0 609 683 | A1 | 8/1994 |
| GB | 2 304 077 | A | 3/1997 |
| WO | WO 98/48275 | | 10/1998 |
| WO | WO 99/47702 | | 9/1999 |

* cited by examiner

*Primary Examiner*—Alain L. Bashore
(74) *Attorney, Agent, or Firm*—Fish & Richardson P.C.

(57) ABSTRACT

The invention relates to a method for forgery-proof labeling of items, such as credit cards, bank notes and the like, comprising the following steps: (a) applying, to a first layer (1) that reflects electromagnetic waves, an inert second layer (3) that is permeable to electromagnetic waves, said second layer having a predetermined thickness, (b) applying, to said second layer (3), a third layer (4) that is formed by metal clusters, and (c) linking the first layer (1) of the label so produced with the item.

21 Claims, 3 Drawing Sheets

METHOD FOR FORGERY-PROOF LABELING OF ITEMS, AND FORGERY-PROOF LABEL

CROSS-REFERENCE TO RELATED APPLICATIONS

Figure 1:
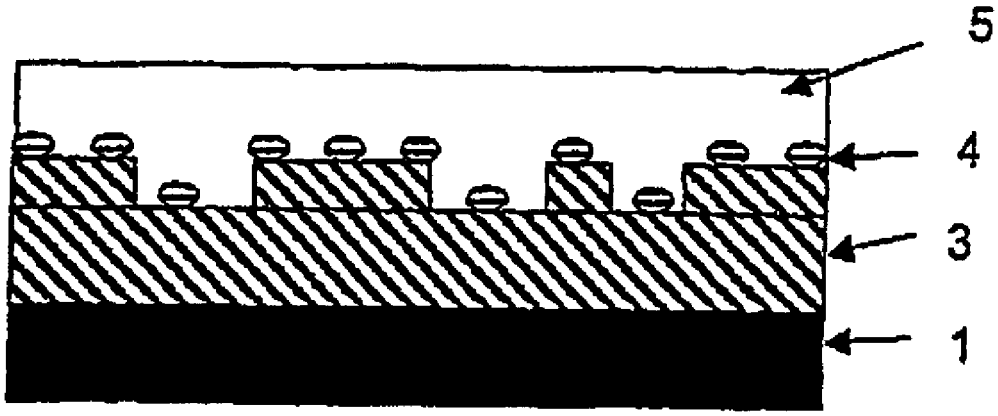

This application is a National Stage application under 35 U.S.C. §371 and claims benefit under 35 U.S.C. §119(a) of International Application No. PCT/DE01/03205 having an International Filing Date of Aug. 16, 2001, which claims benefit of DE 100 42 461.9 filed on Aug. 29, 2000.

The invention relates to a method for the forgery-proof marking of objects, such as check guarantee cards, bank notes, packaging etc. It furthermore relates to a forgery-proof label.

According to the prior art, it is known to provide holograms on check guarantee cards or bank notes as evidence of their authenticity. Furthermore, magnetic codes on magnetic strips or fluorescent labels are affixed as evidence of the authenticity of an object. The known labels can be forged with relative ease.

U.S. Pat. No. 5,611,998 discloses an optochemical sensor. A chemically reactive layer, which changes its volume on contact with a solution containing a substance to be detected, is in this case applied to a metal layer. A layer formed from metallic clusters is applied to the chemically reactive layer. As a result of binding of the substance to be detected, the distance between the layer formed from the metal cluster and the metal layer is changed. At the same time, the absorption of light incident on the sensor is also changed. The presence of the substance to be detected causes a color change of the sensor. The known sensor is not suitable for the forgery-proof marking of objects. A color change occurs only when the sensor is exposed to a liquid phase. Contact with moisture or liquids can also lead to a reaction which triggers or modifies a color signal.

It is an object of the invention to provide a method for the marking of objects, as well as a label, which offer a high level of security against forgery in a straightforward and cost-effective way.

In accordance with the invention, a method is provided for the forgery-proof marking of objects, such as check guarantee cards, bank notes etc., wherein a) an inert second layer with a predetermined thickness, which is transmissive for electromagnetic waves, is applied to a first layer which reflects electromagnetic waves, b) a third layer, formed from metallic clusters, is applied to the second layer and c) the first layer of the label produced in this way is connected to the object.

With the aforementioned features, a forgery-proof permanently visible label can be produced in a straightforward and cost-effective way.

According to further measures of the invention, a method is provided for the forgery-proof marking of objects, such as check guarantee cards, bank notes etc., wherein a) an inert second layer with a predetermined thickness, which is transmissive for electromagnetic waves, is applied to a first layer which reflects electromagnetic waves, b) the first layer of the label produced in this way is connected to the object and c) a third layer, formed from metallic clusters, is applied to a substrate in such a way that it can be arranged at a predetermined distance from the first layer in order to make the label visible.

The further solution pertaining to the method permits invisible marking of an object in a straightforward and cost-effective way. The label is, in particular, forgery-proof. It can be made visible by bringing it into contact with the substrate coated according to the invention.

The second layer is expediently applied in a structured fashion in both methods. The structuring may involve a structure in the surface, such as a pattern or a drawing. It may, however, also involve a relief-type structure. In this case, the label appears in different colors.

According to another configuration feature, an inert fourth layer, which is transmissive for electromagnetic waves, is applied to the third layer. The fourth layer is used primarily for protection of the covered layers.

The substrate may be made from a material which is transmissive for electromagnetic waves, preferably from glass or plastic.

First molecules, which are affine with respect to the second layer or with respect to second molecules provided on it, are expediently applied to the third layer or fourth layer. In this case, polymers, silanes or structurally related compounds may be used as molecules. It is, for example, also conceivable to use complementary polynucleotide sequences, such as DNA, as molecules. The function of the first and second molecules is essentially to bond the substrate to the label at a rigidly predetermined distance.

The metallic clusters may, for example, be made from silver, gold, platinum, aluminum, copper, tin or indium. The second layer and/or fourth layer may be made from one of the following materials: metal oxide, metal nitrite, metal carbide, in particular from silicon oxide, silicon carbide, silicon nitrite, tin oxide, tin nitrite, aluminum oxide, aluminum nitrite or polymer, in particular polycarbonate (PC), polyethylene (PE), polypropylene (PP), polyurethane (PU), polyimide (PI), polystyrene (PS) or polymethacrylate (PMA). These materials are essentially inert chemically. They are insensitive to moisture. The function of the second layer essentially involves permanently providing a predetermined distance from the third layer and/or a predetermined structure.

According to another configuration, a coloration forming the label becomes visible at a distance between the first layer and the third layer of less than 2 μm. The coloration is dependent on the observation angle and is characteristic. To that end, the first layer may be illuminated by means of a device for generating electromagnetic waves, preferably by means of a LASER, fluorescent lamp, light-emitting diode or xenon lamp. The label may be identified by a device for determining the optical properties of the electromagnetic waves reflected by the first layer. The absorption, preferably at different observation angles, may be measured by the device for determining the optical properties. Such determination of the optical properties permits a high level of security against forgery.

According to another configuration feature, at least some of the layers is/are produced by means of thin-film technology. In particular, vacuum coating technologies etc. are suitable for this.

According to another configuration feature, at least one of the layers is made from a material with anisotropic refractive index. Preferably, the second layer is made from a material with anisotropic refractive index. The material may, for example, involve liquid-crystal polymers which show a characteristic coloration both at a different observation angles, that is to say angles relative to the z axis, and at different rotation angles, that is to say angles in the x-y plane.

According to another configuration feature, at least one of the layers may be made from a material whose optical properties can be deliberately modified after the layer is applied.

This material may, for example, involve a photosensitive polymer, whose refractive index can be changed by illumination with suitable wavelength.

According to the invention, a forgery-proof label for objects, such as check guarantee cards, bank notes etc., is furthermore provided, wherein an inert second layer with a predetermined thickness, which is transmissive for electromagnetic waves, is applied to a first layer which reflects electromagnetic waves and which is connected to the object, and wherein a third layer, formed from metallic clusters, is applied to the second layer. —Such a label is permanently visible; it is highly forgery-proof.

According to further measures of the invention, a forgery-proof label for objects, such as check guarantee cards, bank notes etc., is provided, wherein an inert second layer with a predetermined thickness, which is transmissive for electromagnetic waves, is applied to a first layer which reflects electromagnetic waves and which is connected to the object. —Such a label is invisible.

If the surface of the object to be labeled is already made from a material which reflects electromagnetic waves, for example a metal, the first layer may be formed by the object itself.

A third layer, formed from metallic clusters, may be applied to a substrate in such a way that it can be arranged at a predetermined distance from the first layer in order to make the label visible.

Regarding other configurational features of the forgery-proof label, reference is made to the previous comments about the method.

Figure 2:
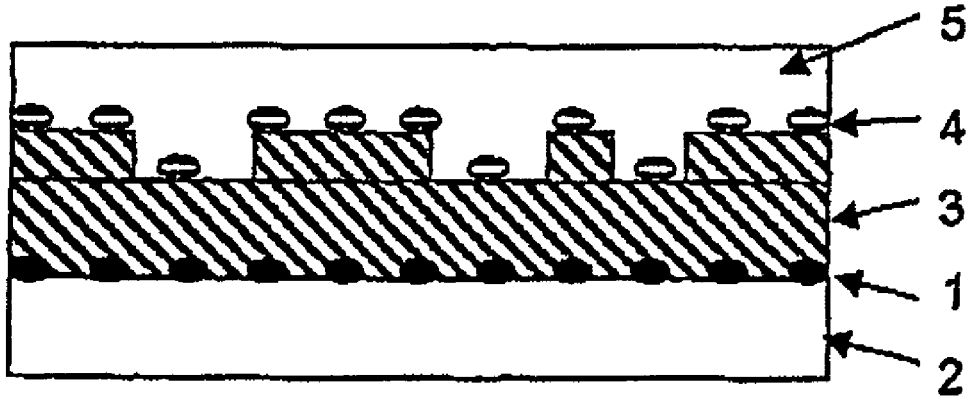
Figure 3:
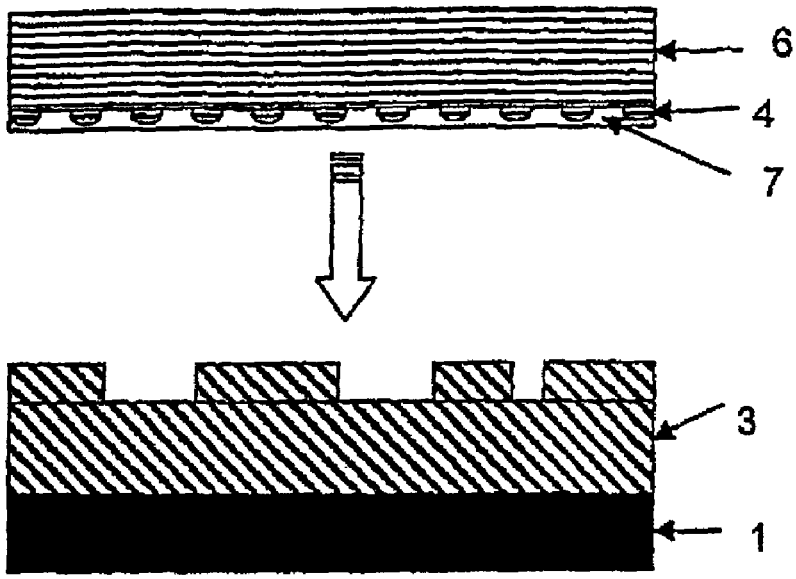
Figure 4:
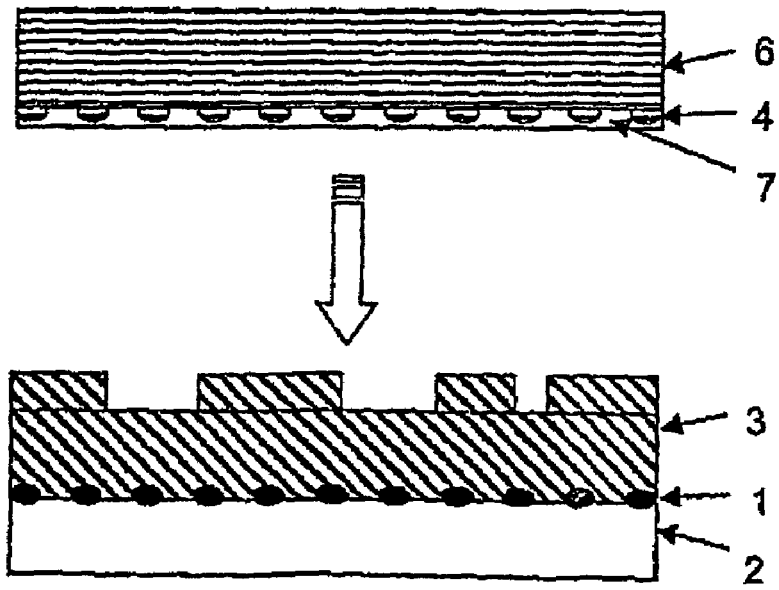
Figure 5:
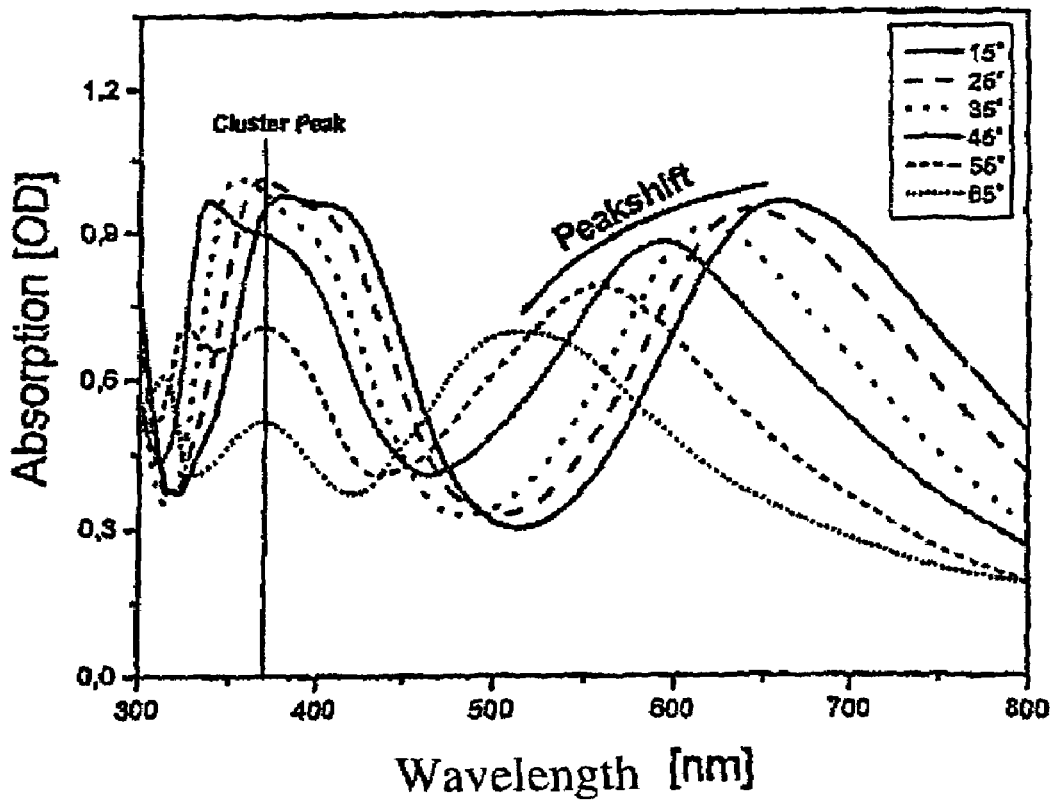
Figure 6:
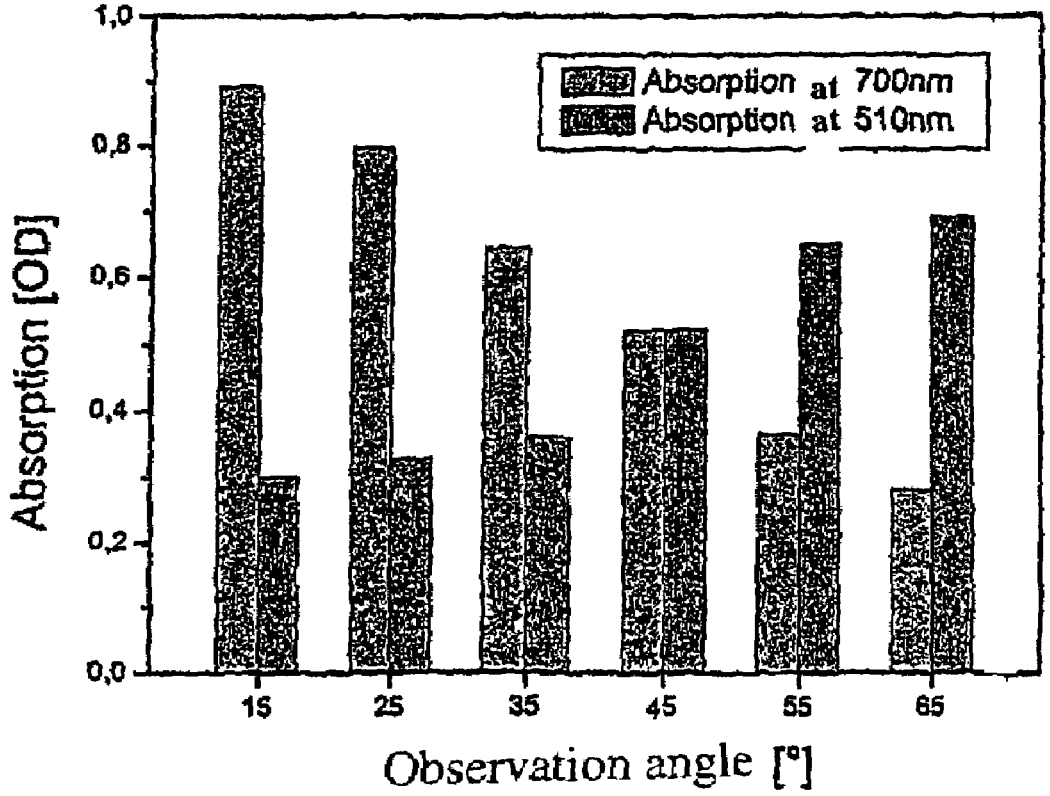

Exemplary embodiments of the invention will be explained in more detail below with reference to the drawings, in which:

FIG. 1 shows a schematic cross-sectional view of a first constantly visible label, FIG. 2 shows a schematic cross-sectional view of a second constantly visible label, FIG. 3 shows a schematic cross-sectional view of a first label which is not constantly visible, and of a substrate suitable for making it visible, FIG. 4 shows a schematic cross-sectional view of a second label which is not constantly visible, and of a substrate suitable for making it visible, FIG. 5 shows absorption spectra of a label according to FIG. 1 at different observation angles, FIG. 6 shows a quantitative evaluation of the spectra according to FIG. 5 at different wavelengths.

In the labels shown in FIGS. 1 to 4, a first layer which reflects electromagnetic waves is denoted by 1. It may be a metal foil, for example an aluminum foil. The first layer 1 may, however, also be a layer which is formed from clusters and which is applied to a support 2. The support 2 may be the object to be labeled. The clusters are expediently made from gold. The first layer 1 shown in FIGS. 1 and 3 may also be the object, if the latter's surface is formed from a material which reflects electromagnetic waves.

A chemically inert second layer 3 is applied to the first layer 1. The second layer 3 has a structure. The structure is designed here in the form of a relief, which, for example, is configured in the manner of a bar code. The thickness of the second layer is preferably between 20 and 1000 nm. It is applied by means of thin-film technology. Vacuum coating methods, for example, are suitable for this.

In the label shown in FIGS. 1 and 2, a third layer 4 produced from metallic clusters is applied to the second layer 3. The third layer 4 is in turn overlaid by a fourth layer 5. The fourth layer 5 protects the underlying layers against damage. The fourth layer 5 may, like the second layer 3, be made from a chemically inert and optically transparent material, for example a metal oxide, metal nitrite, metal carbide or polymer.

The labels shown in FIGS. 3 and 4 are only visible when they are brought into contact with a substrate 6, onto whose surface the third layer 4 formed from metal clusters is applied. The third layer 4 may be overlaid with a fifth layer 7 formed from first molecules. The fifth layer 7 is expediently formed from molecules which are affine with respect to the material from which the second layer 3 is made. Upon contact of the fifth layer 7 with the second layer 3, specific adhesion therefore takes place. It is also possible for the second layer 3 to be covered with a further fifth layer 7. In this case, the fifth layers 7 are respectively formed from molecules which have an affinity with respect to one another. This may involve biopolymers which are mutually complementary. The fifth layer 7 may, however, also be made from other polymers, silanes and/or structurally related compounds.

The substrate 6 is made from a transparent material, for example from glass or plastic.

The function of the label is as follows:

When light is shone from a light source, for instance a LASER, a fluorescent tube or a xenon lamp, onto a label shown in FIGS. 1 and 2, this light is reflected at the first layer 1. Owing to an interaction of the reflected light with the third layer 4 formed from the metal clusters, some of the incident light is absorbed. The reflected light has a characteristic spectrum. The label appears colored. The coloration, which depends on the angle of incidence or observation angle, is used as forgery-proof evidence of the authenticity of the label.

In the label shown in FIGS. 3 and 4, only the optically transparently designed second layer 3 is applied to the electromagnetically reflective first layer 1. The second layer 3 may consist of chemically inert materials, such as silicon oxide, silicon carbide, silicon nitrite, tin oxide or tin nitrite or of aluminum oxide or aluminum nitrite. The label is initially not visible.

When the optically transparent substrate 6 provided with the third layer 4 is applied, an interaction can take place between the light reflected at the first layer 1 and the third layer. A color effect is again obtained, which can be observed through the substrate 6, preferably made from glass.

In order to ensure that the predetermined distance, which is required for generation of the color effect, is established between the first layer 1 and the third layer 4, the third layer 4 may be covered with a fifth layer 7. Upon contact of the fifth layer 7 with the second layer 3, the substrate 6 adheres to the label. A predetermined distance is established between the third layer 4 and the first layer 1.

Concerning the parameters which need to be complied with for generation of the interactions, reference is made to U.S. Pat. No. 5,611,998, WO 98/48275 and WO 99/47702, the content of whose disclosure is hereby included.

The spectra of a label according to FIG. 1, which are shown in FIG. 5, were measured by means of a Lambda 25 UV/VIS spectrometer from Perkin Elmer by using a reflection arrangement. It can be seen from FIG. 5 that the longer-wave peak is shifted toward shorter wavelengths as the observation angle increases. A stationary peak can also be observed, which is attributable to the silver cluster.

FIG. 6 shows a quantitative evaluation of the spectra according to FIG. 5, in each case at two different wavelengths. At the wavelengths in question, modified absorption is observed as a function of the observation angle. The absorption pattern is characteristic of the authenticity of the label.

LIST OF REFERENCES

1 first layer
2 support
3 second layer
4 third layer
5 fourth layer
6 substrate
7 fifth layer

The invention claimed is:

1. A method for forgery-proof marking of objects, comprising a) applying an inert second layer (3) to a first layer (1), wherein said first layer (1) reflects electromagnetic waves, wherein said second layer (3) has a predetermined thickness, is transmissive for electromagnetic waves, and is made from a polymer selected from the group consisting of a polycarbonate (PC), a polyethylene (PE), a polypropylene (PP), a polyurethane (PU), a polyimide (PI), a polystyrene (PS), or a polymethacrylate (PMA);

b) applying a third layer (4) to said second layer (3) to thereby generate a label, wherein said third layer (4) is formed from metallic clusters, wherein, due to an interaction of light reflected from the first layer (1) with the third layer (3), the label appears colored, the color depending upon the angle of incidence or angle of observation; and c) connecting said label to said object.

2. The method of claim 1, wherein said object is selected from the group consisting of check guarantee cards, bank notes, and packaging.

3. The method of claim 1, further comprising applying an inert fourth layer (5) to said third layer (4), wherein said fourth layer (5) is transmissive for electromagnetic waves.

4. The method of claim 3, wherein at least one of said layers (3, 4, 5) is applied in a structured fashion, wherein the structured fashion is a pattern, drawing or relief-type structure on the surface.

5. The method of claim 3, further comprising applying first molecules (7) to said third layer (4) or said fourth layer (5), wherein said first molecules (7) are affine with respect to said second layer (3) or with respect to second molecules provided on said second layer (3).

6. The method of claim 5, wherein said first molecules and/or said second molecules are selected from the group consisting of polymers, silanes, and structurally related compounds.

7. The method of claim 1, wherein said metallic clusters are silver, gold, platinum, aluminum, copper, tin, or indium.

8. The method of claim 3, wherein said second layer (3) and/or said fourth layer (5) is/are made from a metal oxide, a metal nitrite or a metal carbide.

9. The method of claim 8, wherein said second layer (3) and/or said fourth layer (5) is/are made from silicon oxide, silicon carbide, silicon nitrite, tin oxide, tin nitrite, aluminum oxide, aluminum nitrite, or a polymer.

10. The method of claim 1, further comprising illuminating said label by means of a device for generating electromagnetic waves.

11. The method of claim 10, wherein said means of a device for generating electromagnetic waves is selected from the group consisting of a LASER, a fluorescent lamp, a light-emitting diode, and a xenon lamp.

12. The method of claim 1, further comprising identifying said label using a device for determining optical properties of electromagnetic waves reflected by said first layer (1).

13. The method of claim 12, wherein said determining said optical properties is from different observation angles.

14. The method of claim 12, wherein said optical property is absorption.

15. The method of claim 3, wherein at least some of said layers (1, 3, 4, 5) is/are produced by means of thin-film technology.

16. The method of claim 3, wherein at least one of said layers (3, 4, 5) has an anisotropic refractive index.

17. The method of claim 3, wherein at least one of said layers (1, 3, 4, 5) is made from a material whose optical properties can be modified after the layer is applied.

18. A method for forgery-proof marking of objects, comprising:

(a) applying an inert second layer (3) to a first layer (1), wherein said second layer (3) has a predetermined thickness, is transmissive for electromagnetic waves, and is made from a polymer selected from the group consisting of a polycarbonate (PC), a polyethylene (PE), a polypropylene (PP), a polyurethane (PU), a polyimide (PI), a polystyrene (PS), or a polymethacrylate (PMA), wherein said first layer (1) reflects electromagnetic waves;

(b) connecting said first layer (1) to said object, thereby generating a label; and (c) applying a third layer (4) to a substrate (6), wherein said third layer (4) is formed from metallic clusters, wherein said third layer (4) is affanged at a predetermined distance from said first layer (1) such that said label becomes visible in a way that, due to an interaction of light reflected from the first layer with the third layer (3), the label appears colored, the color depending on the angle of incidence or angle of observation.

19. The method of claim 18, wherein said substrate (6) is made from a material that is transmissive for electromagnetic waves.

20. The method of claim 19, wherein said substrate is (6) is glass or plastic.

21. The method of claim 18, wherein said label forms a visible color when the distance between said first layer (1) and said third layer (4) is less than 2 μm.

* * * * *

UNITED STATES PATENT AND TRADEMARK OFFICE

CERTIFICATE OF CORRECTION

PATENT NO. : 7,396,557 B2
APPLICATION NO. : 10/363111
DATED : July 8, 2008
INVENTOR(S) : Georg Bauer It is certified that error appears in the above-identified patent and that said Letters Patent is hereby corrected as shown below:

Title Page, [57] Abstract, line 4, please delete “an” and insert --and-- therefor;

Column 6, line 40 (Claim 18), please delete “affanged” and insert --arranged-- therefor.

Signed and Sealed this

Sixteenth Day of June, 2009

JOHN DOLL
*Acting Director of the United States Patent and Trademark Office*